United States Patent [19]

Philipson

[11] 4,215,512

[45] Aug. 5, 1980

[54] HARMLESS SONIC TOY

[76] Inventor: Stanley J. Philipson, 1161 York Ave., New York, N.Y. 10021

[21] Appl. No.: 23,162

[22] Filed: Mar. 23, 1979

[51] Int. Cl.[3] ..... A63H 5/00

[52] U.S. Cl. ..... 46/195; 46/1 E

[58] Field of Search ..... 46/176, 194, 195, 196, 46/174, 175 R, 192, 1 E; 42/54, 57

[56] References Cited

U.S. PATENT DOCUMENTS

| | | | |
|---|---|---|---|
| 1,089,166 | 3/1914 | Van Doren | 46/196 |
| 1,419,646 | 6/1922 | Savage | 42/57 |
| 3,357,128 | 12/1967 | Geiser | 46/194 |

*Primary Examiner*—Russell R. Kinsey
*Assistant Examiner*—Mickey Yu
*Attorney, Agent, or Firm*—Mark T. Basseches; Paula T. Basseches

[57] ABSTRACT

The present invention relates to a sonic toy device, and particularly to a gun-like toy. In accordance with the invention, a pair of closely spaced rolls are mounted on a frame to define a nip therebetween. A hand crank is provided for rotating at least one of the rolls and an elongate, stretchable plastic film defining a plurality of longitudinally spaced sealed air pockets is mounted in driving connection in the nip between the rolls, the thickness of the pockets exceeding the spacing of the rolls at the nip whereby, on rotation of the rolls, the strip is progressively advanced through the nip and the pockets are burst, with the accompanying production of a sound at each burst.

5 Claims, 3 Drawing Figures

FIG. 1
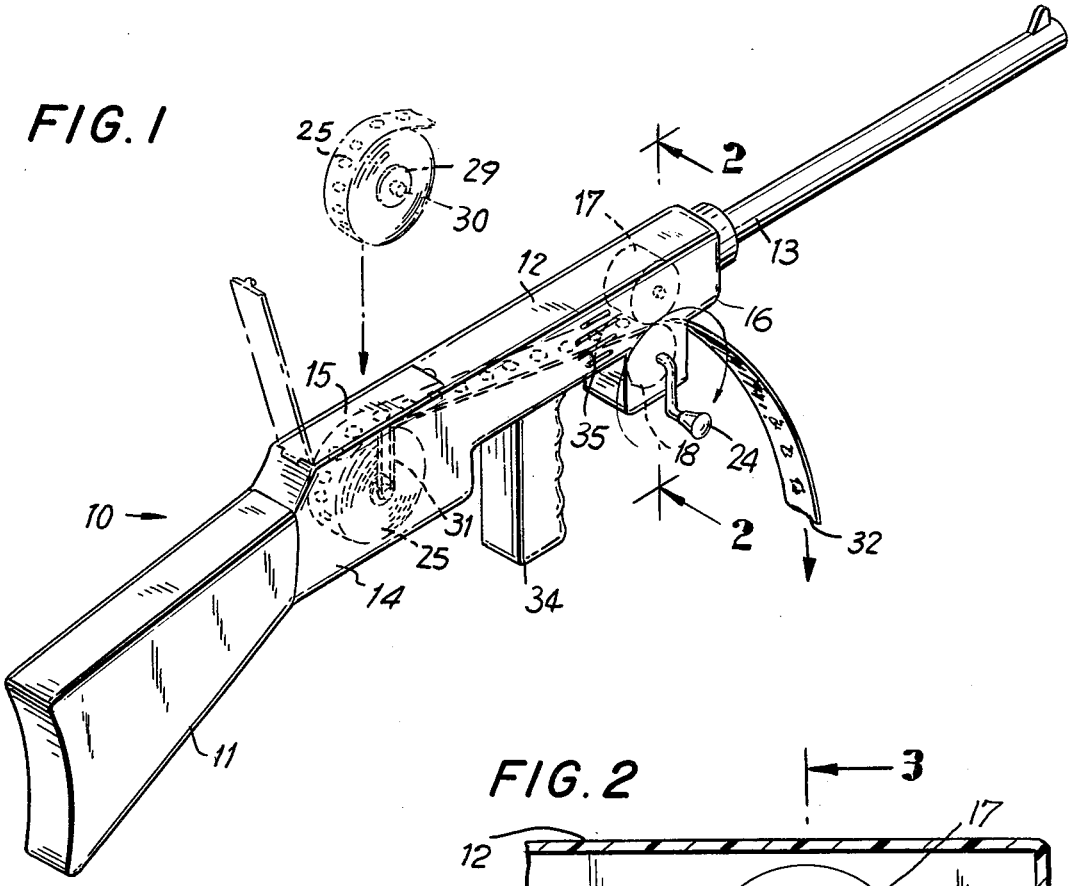
FIG. 2
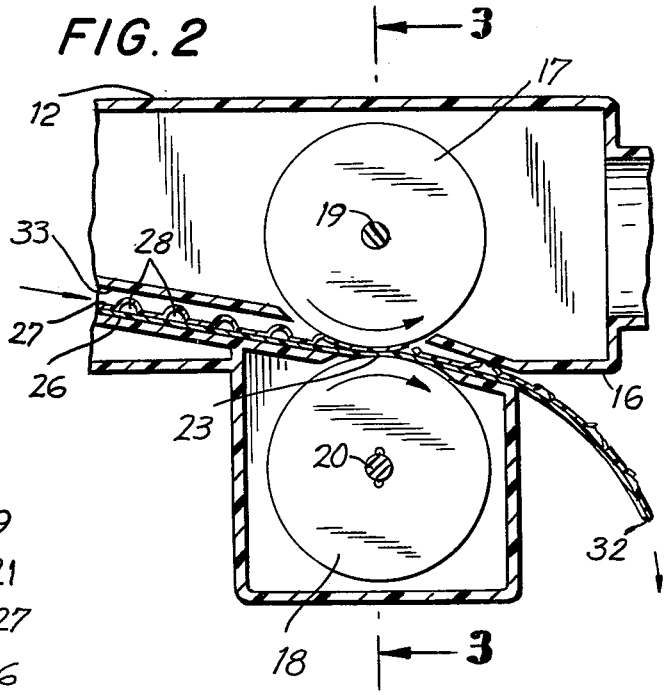
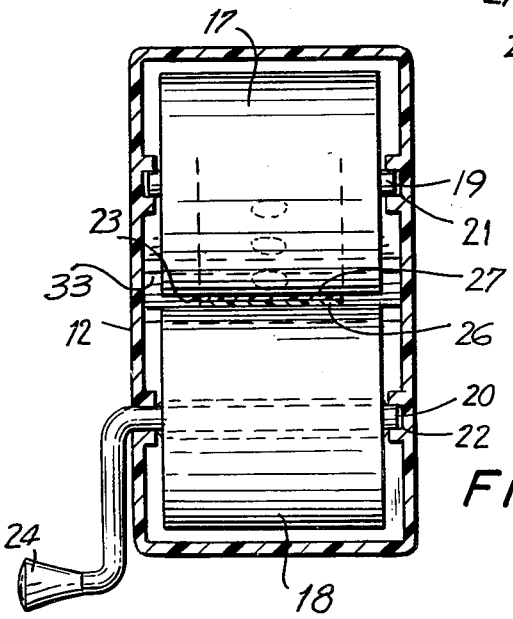
FIG. 3

HARMLESS SONIC TOY

BACKGROUND OF THE INVENTION

1. Field of the Invention

This invention is in the field of a harmless sound-producing child's toy.

2. The Prior Art

Numerous devices have been created for the amusement of children by way of noise makers, toy guns and the like. Where such devices create sound by the impact of a resilient hard member against a ratchet wheel or the like, the sound is not simulative of gun fire.

To create a more realistic simulation of gun fire, use has been made of caps, being increments of gunpowder attached at spaced positions along a paper carrier. However, the explosion of a cap creates hazards by way of sparking, and also the rapidly expanding burnt particles may detonate in close proximity to a child's eye or ear, resulting in injury.

SUMMARY OF THE INVENTION

The present invention may be summarized as directed to a child's toy, such as a noise maker, but particularly to a gun, such as a machine gun. The invention employs a frame which carries a pair of closely spaced rolls mounted for rotation about parallel axes, the closest point of approach of the rolls defining a nip.

A length or strip of stretchable plastic film is led into the nip, the film including a plurality of longitudinally spaced-apart sealed air pockets. Means are provided for rotating at least one of the rolls whereby the strip is progressively advanced between the rolls, with accompanying sonic reports as each pocket passes through the nip and bursts.

In accordance with a preferred embodiment, the frame is gun-shaped, the rolls are housed within a resonant chamber within the frame, and one of the rolls is provided with a crank handle enabling the same to be rapidly rotated, whereby a strip is advanced briskly between the rolls, providing a sound reminiscent of machine gun chatter.

Accordingly, it is an object of the invention to provide a harmless sonic toy.

A further object of the invention is the provision of a child's toy particularly in the form of a gun.

A still further object of the invention is the provision of a child's toy of the type described, utilizing as "ammunition" a roll or length of plastic material of the type commonly employed as a shock absorber in the shipment of fragile articles, such material including, as is well known, a spaced pair of films, one or both of which have been distorted at intervals to define sealed pockets or chambers of greater thickness than the thickness of the film, the chambers encompassing volumes of air.

To attain these objects and such further objects as may appear herein or be hereinafter pointed out, reference is made to the accompanying drawings, forming a part hereof, in which:

FIG. 1 is a perspective view of an embodiment of the invention;

FIG. 2 is a magnified sectional view taken on the line 2—2 of FIG. 1;

FIG. 3 is a section taken on the line 3—3 of FIG. 2.

Turning now to the drawings, there is disclosed in FIG. 1 a noise maker device, illustratively in the form of a gun 10, such as a machine gun. The gun 10, which is preferably made of rigid plastic material, may include a stock 11 fixed to a hollow frame member 12, and a simulated barrel 13 fixed to the front end of the frame 12.

The frame 12 may include a hollow magazine 14 having a pivotal lid 15 for facilitating loading, as hereinafter more particularly set forth.

Adjacent the forward end 16 of the device there is mounted a pair of rolls, namely, a idler roll 17 and a drive roll 18. The rolls include pivot axes 19, 20, respectively, fitted within bearing sockets 21, 22, respectively, the axes and bearing sockets being arranged to mount the rolls rotatably about parallel axes. The spacing of the rolls is such as to provide a nip 23 at the point of closest approach between the periphery of the rolls, the nip defining a linear area parallel to the axes of rotation of the rolls. The spacing or dimension of the rolls at the nip is maintained preferably at a minimal value.

The drive roll 18 is provided with a hand operated crank 24 or a like device for effecting rotation of the roll 18. Obviously alternative driving mechanisms, such as an electrically operated motor or a trigger draw assembly may be substituted for the crank 24.

The apparatus includes as a consumable element for creating the desired sound, a roll 25 comprising an elongate strip of plastic film of the type typically employed in large sheets for the protection of fragile items during shipment. The material, as is well known, is generally comprised of thin stretchable plastic film, such as polyethylene film. The film is typically fabricated of a pair of superimposed sheets or layers 26, 27, at least one of which layers, e.g. the layer 27, is provided with raised pockets 28. The periphery of the pockets 28 is sealed to the sheet 26 such as to define an encapsulated or enclosed volume of air within the pocket.

In practice the device is used by "loading" the gun, such loading operation involving dropping a roll 25 of the "ammunition" into the magazine 14, the material being preferably mounted on a spool 29 having laterally projected stop shafts 30 adapted to be received in opposed slots 31 formed in the magazine.

A lead portion 32 of the roll is led forwardly of the frame into the nip between the rolls 17, 18, the under surface of the frame 12 being provided with an access slot 33 to facilitate introduction of the lead end into the nip 23 between the rolls. The drive roll 18 is advanced through the use of the crank handle 24 until the plastic film is gripped between the rolls.

The device is used by grasping the grip portion 34 and pressing the stock against the shoulder while at the same time rotating the crank handle 24 to cause a length of the strip material to be advanced progressively through the nip between the rolls. Such advancing movement of the strip material is accompanied by a bursting or popping sound as the individual pockets 28 are ruptured by their being crushed in the nip of the rolls. The rapidity of the popping sounds may be controlled by the speed with which the crank is rotated.

Preferably the frame 12 is hollow, defining a resonating chamber and thus accentuating the popping sound, the chamber being provided with a port 35 for egress of the sound.

As will be appreciated from the above description, there is provided in accordance with the invention, a noise making toy, such as a gun, which operates safely and which creates popping sounds without danger of injury to the user.

The material employed as "ammunition" is inexpensive and readily available.

While the device has been illustrated in conjunction with a simulated machine gun, it will be readily recognized that the combination of rolls and ammunition may suitably be embodied in any of a plurality of devices other than guns without departing from the spirit of the invention.

While the ammunition has been disclosed as comprised of a roll of spirally wound pocketed film, it will be readily recognized that lengths or strips may be suitably employed.

Accordingly, the invention is to be broadly construed within the scope of the appended claims.

Having thus described the invention and illustrated its use, what is claimed as new and is desired to be secured by Letters Patent is:

1. A harmless sonic toy device comprising, in combination, a frame member, a cylindrical idler roll mounted for rotation on said frame member, a cylindrical drive roll mounted for rotation on said frame member, said drive and idler rolls having their axes of rotation disposed in parallel spaced relation and having peripheral portions disposed in proximate spaced relation to define a nip, means for rotating said drive roll and an elongate strip of air impervious stretchable plastic film disposed in driving connection in the nip between said rolls, said strip including a plurality of longitudinally spaced-apart sealed air containing pockets, the thickness of said pockets exceeding the spacing of said rolls at said nip whereby rotation of said drive roll progressively advances said strip through said nip and consequently bursts said pockets.

2. Apparatus in accordance with claim 1 wherein said frame member is shaped to resemble a gun.

3. Apparatus in accordance with claim 2 wherein said frame includes magazine means and said strip is wound to a spiral conformation disposed in said magazine means.

4. Apparatus in accordance with claim 1 wherein said means for rotating said drive roll comprises a crank handle.

5. A device in accordance with claim 1 wherein said frame member is hollow, and said rolls are disposed within a hollow chamber defined by said frame member, forming a resonant chamber, said chamber including a port extending through said frame.

* * * * *